United States Patent [19]

Thilmony

[11] Patent Number: 4,702,643

[45] Date of Patent: Oct. 27, 1987

[54] COMPACTION WHEEL

[76] Inventor: James C. Thilmony, 607 11th St., Mandan, N. Dak. 58554

[21] Appl. No.: 826,610

[22] Filed: Feb. 6, 1986

[51] Int. Cl.[4] ..... E01C 19/26

[52] U.S. Cl. ..... 404/121; 404/129; 172/548; 172/555

[58] Field of Search ..... 172/548, 540, 555, 554; 404/121, 128, 129, 122

[56] References Cited

U.S. PATENT DOCUMENTS

| | | | |
|---|---|---|---|
| 894,346 | 7/1908 | Ross | 404/121 |
| 3,171,498 | 3/1965 | Logan | 172/554 X |
| 3,318,209 | 5/1967 | Schultz | 172/548 |
| 3,891,342 | 6/1975 | Roe | 404/128 |
| 4,066,374 | 1/1978 | King | 404/117 |
| 4,070,974 | 1/1978 | Stacy | 172/555 |
| 4,278,368 | 7/1981 | Livesay | 404/121 |
| 4,280,770 | 7/1981 | Woodruff | 404/133 |
| 4,411,081 | 10/1983 | King | 404/121 |
| 4,439,057 | 3/1984 | Sprague | 404/133 |
| 4,490,070 | 12/1984 | Upchurch | 404/121 |
| 4,610,567 | 9/1986 | Hosking | 172/548 |

FOREIGN PATENT DOCUMENTS

| | | | |
|---|---|---|---|
| 986352 | 3/1965 | United Kingdom | 172/540 |

*Primary Examiner*—Richard J. Johnson

*Attorney, Agent, or Firm*—Zarley, McKee, Thomte, Voorhees & Sease

[57] ABSTRACT

A compaction wheel is described which is suited for use with a backhoe or the like having a pivotal boom arm extending therefrom. The compaction wheel includes a supporting frame which is pivotally secured to the free end of the backhoe boom arm. A plurality of vertically disposed and horizontally spaced flat wheel members are rotatably mounted on the supporting frame and have compaction members projecting radially therefrom. In one form of the invention, the compaction members take the form of square tubes while in a modified form of the invention, the compaction members take the form of flat wege members.

5 Claims, 5 Drawing Figures

COMPACTION WHEEL

BACKGROUND OF THE INVENTION

This invention relates to a compaction wheel and more particularly to a compaction wheel which may be mounted on the boom arm of a backhoe or the like to compact dirt in a trench or the like.

On construction sites, trenches are frequently dug which must later be refilled. It is important that the fill dirt placed in the trench be compacted to prevent subsequent settling. Many devices have been previously provided for compacting the dirt or soil within the trench but the same are generally less than efficient and are extremely expensive. A large majority of the conventional compaction devices comprise a closed cylinder or the like having a plurality of radially extending teeth provided on the circumference thereof. The closed cylinder construction limits the amount of penetration of the compaction wheel since the compaction wheel will normally only penetrate the soil a distance equal to the length of the protruding teeth. Such a limitation necessarily reduces the efficiency of the device and results in less than complete compaction.

It is therefore a principal object of the invention to provide an improved compaction wheel.

A further object of the invention is to provide an improved compaction wheel which may be mounted on the boom arm of a backhoe or the like.

Still another object of the invention is to provide a compaction wheel for a backhoe or the like which permits soil penetration up to the axle of the compaction wheel.

Yet another object of the invention is to provide a compaction wheel for a backhoe or the like which is extremely efficient.

Still another object of the invention is to provide a compaction wheel for a backhoe or the like which is economical of manufacture, durable in use and refined in appearance.

These and other objects will be apparent to those skilled in the art.

BRIEF DESCRIPTION OF THE DRAWINGS

FIG. 1 is a side view illustrating the compaction wheel of this invention mounted on the boom arm of a backhoe or the like:

SUMMARY OF THE INVENTION

A compaction wheel is described which is suited for use with a backhoe or the like having a boom arm pivotally mounted thereon. The compaction wheel includes a supporting frame which is pivotally secured to the end of the boom arm. A horizontally disposed axle is mounted on the supporting frame and has a plurality of vertically disposed and horizontally spaced-apart rotatable wheel members mounted thereon. A plurality of compaction members are mounted on each of the wheel members and protrude radially outwardly from the peripheries thereof. In one form of the invention, the compaction members take the shape of hollow tube members. In another form of the invention, the compaction members take the form of flat wedges. The compaction members on each of the wheel members are radially spaced with respect to the compaction members on the next adjacent wheel member. The spacing of the wheel members permits the wheel members to penetrate the fill dirt or soil up to the axle thereby increasing the efficiency of the compaction wheel.

DESCRIPTION OF THE PREFERRED EMBODIMENT

Figure 1:
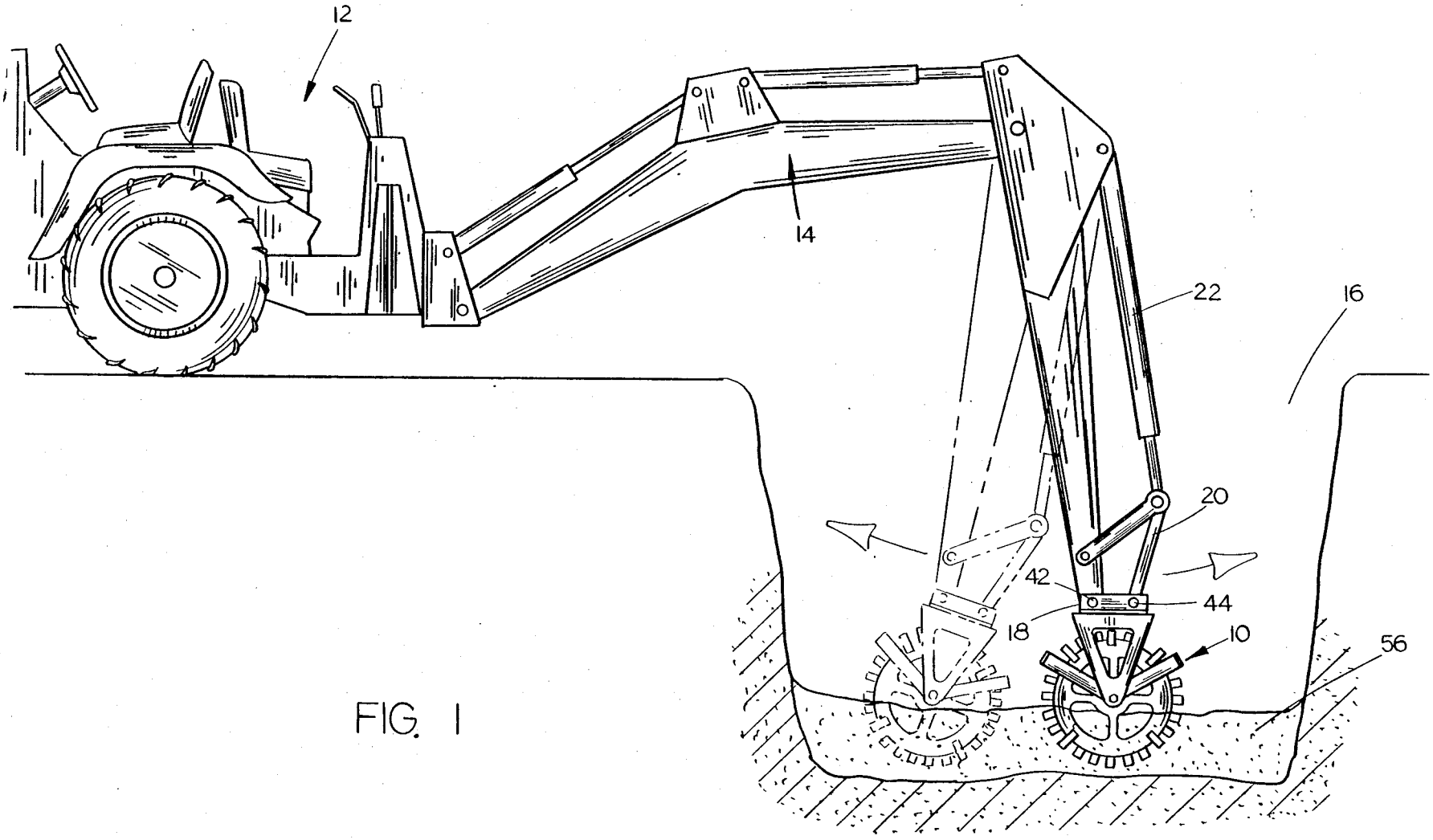

The compaction wheel of this invention is referred to generally by the reference numeral 10 while the reference numeral 12 refers to a backhoe or the like having a pivotal boom arm 14 mounted thereon. In FIG. 1, the numeral 16 refers to a trench or the like with the backhoe being positioned at one side thereof. In most situations, however, the backhoe would be straddling the trench 16. For purposes of description, the boom arm 14 will be described as having a free end 18 and a linkage 20 connected to a hydraulic cylinder 22.

Compaction wheel 10 includes a supporting frame 24. Supporting frame 24 includes a base portion 26 having spaced-apart sides 28 and 30. A bracket 32 extends upwardly from supporting frame 24 including a pair of opposite sides 34 and 36. Each of the sides 34 and 36 include a pair of spaced-apart openings 38 and 40 formed therein to facilitate the connection of the bracket means 32 to the boom arm 14 and linkage 20 by means of pins 42 and 44 respectively.

Figure 2:
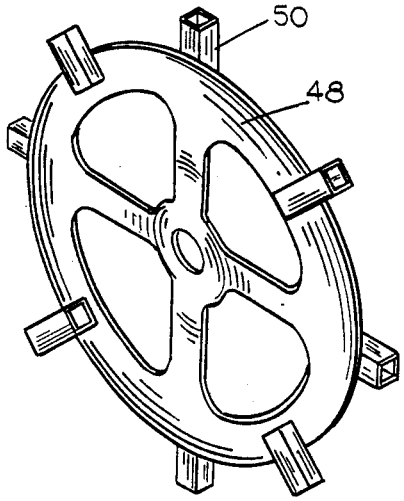
FIG. 2 is a perspective view of one form of the compaction wheel members.
Figure 3:
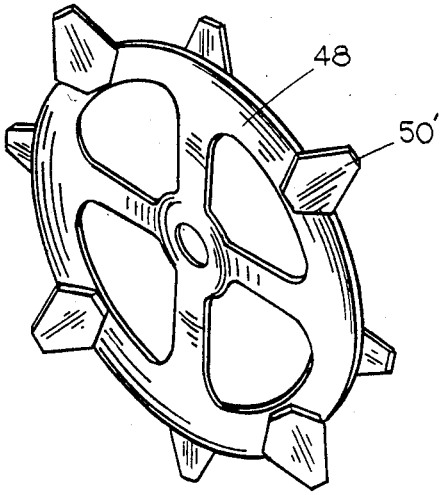
FIG. 3 is a perspective view illustrating a modified form of the compaction wheel member.
Figure 4:
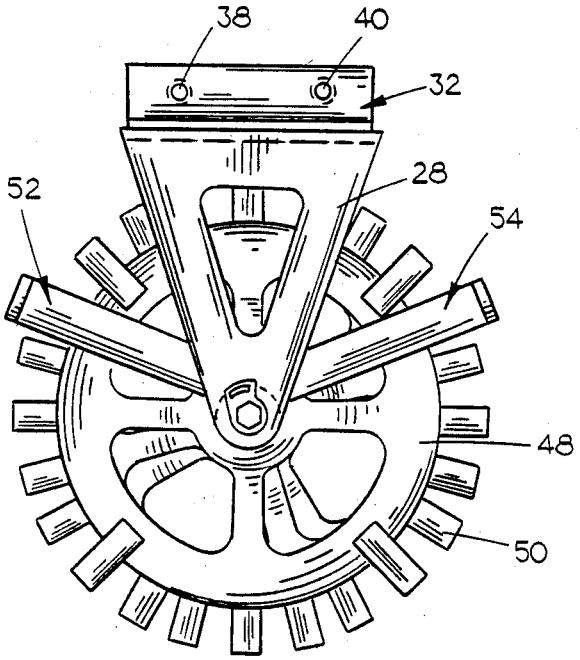
FIG. 4 is a side view of the compaction wheel of this invention.
Figure 5:
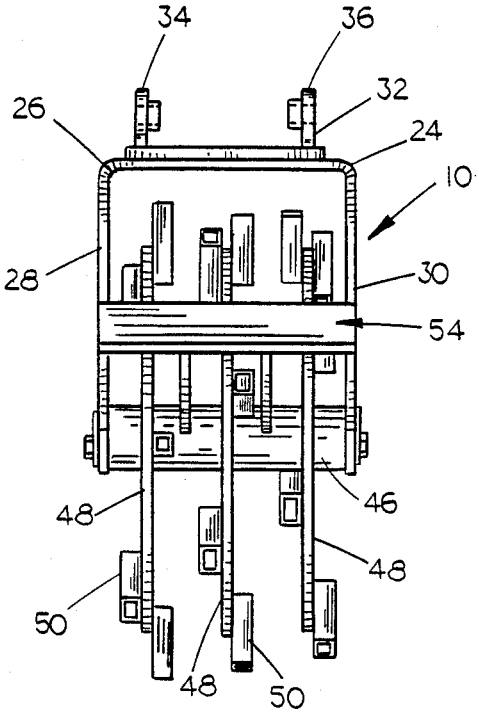
FIG. 5 is an end view of the compaction wheel of this invention.

An axle means or hub 46 extends between the lower ends of the sides 28 and 30 and have a plurality of substantially flat wheel members 48 mounted thereon for rotation therewith. As seen in the drawings, the wheel members 48 are substantially vertically disposed and are horizontally spaced apart. A plurality of compaction members 50 are secured to each of the wheel members 48 adjacent the peripheries thereof and extend radially outwardly therefrom. In the embodiment of FIGS. 2 and 5, the compaction members 50 take the shape of square tubular members. As seen in FIGS. 2 and 5, the compaction members 50 are alternately positioned on opposite sides of the wheel member 48. A modified form of the invention is illustrated in FIG. 3 wherein the compaction members take the form of flat wedge members 50'. A U-shaped blade member 52 is secured to supporting frame 28 and extends upwardly and rearwardly therefrom as illustrated in FIG. 4. Similary, a U-shaped blade 54 is secured to supporting frame 28 and extends upwardly and forwardly therefrom around the upper forward portions of the wheel members 48 as seen in FIGS. 4 and 5. As shown in FIG. 5, scraper members 55 extend from the base portion **54*a* of blade 54 between each pair of wheel members 48, to axle 46 so as to clean wheel members 48 as they rotate during operation. A second pair of scraper members (not shown) extend from base portion 52*a* of blade 52** in a similar manner.

In use, the compaction wheel is secured to the boom arm 14 and the linkage 20 by means of the pins 42 and 44. A portion of the fill dirt 56 is then deposited in the trench 16 and the compaction wheel 10 is lowered into the trench 16 by the boom arm 14. The compaction wheel 10 is forced downwardly into the fill dirt 56 as illustrated in FIG. 1 and the same is permitted by the spacing of the wheel members 48. The compaction wheel 10 enters the fill dirt up to approximately the hub or axle of the apparatus. The boom arm 14 is then manipulated in a back and forth motion as illustrated by the arrows in FIG. 1 which causes the wheel members to rotate with the compaction members 50 compacting the fill dirt 56 from the bottom portion of the fill dirt upwardly. The continued back and forth movement of the compaction wheel causes the fill dirt 56 to be compacted and the wheel 10 will gradually move upwardly relative to the fill dirt 56 as the fill dirt becomes compacted.

The blades 52 and 54 may also be utilized to move dirt within the trench 16 by simply pivotally moving the supporting frame 24 relative to the boom arm so that one of the blades moves into engagement with the fill dirt. When one of the blades is in engagement with the fill dirt, the blade will drag or move the fill dirt when the boom arm 14 is moved backwardly and forwardly.

Thus it can be seen that a novel compaction wheel has been provided for a backhoe or the like. Although the invention is described as being ideally suited for use with a backhoe, the compaction wheel could be mounted on any boom arm if so desired.

Thus it can be seen that the invention accomplishes at least all of its stated objectives.

I claim:

1. A compaction wheel for use with a backhoe or the like having a boom arm pivotally mounted thereon, comprising, a generally U-shaped support frame means adapted to be pivotally connected to the boom arm, a horizontally disposed axle means mounted on said supporting frame means and having opposite ends, a plurality of vertically disposed and horizontally spaced rotatable wheel disc members mounted on said axle means, each disc having a plurality of openings therein, a plurality of compaction members mounted alternately and on opposite sides of each of said wheel members and protruding outwardly from the peripheries thereof, said compaction members on each said wheel member being circumferentially offset with respect to the compaction members on the other wheel members, the periphery of said wheel between said discs being open and unobstructed from said compaction members to said axle means, and a U-shaped blade means having each leg of the U-shape mounted to said support frame, said blade means extending outwardly from and substantially perpendicularly to said axle means, with the base portion of said U-shape parallel to said axle and proximal to the periphery of said compaction members.

2. The compaction wheel of claim 7 wherein each of said compaction members comprises a hollow tube means.

3. The compaction wheel of claim 7 wherein each of said compaction members comprises a flat wedge means.

4. The compaction wheel of claim 1 further comprising scraper members mounted on said blade means and extending from the base portion of said U-shape between each pair of wheel members to said axle means, whereby said scaper members will clean dirt and mud from said wheel members.

5. The compaction wheel of claim 1, further comprising a second U-shaped blade means having each leg mounted to said support frame, said blade means extending outwardly from and substantially perpendicularly to said axle means, with the base portion of said U-shape parallel to said axle and proximal to the periphery of said compaction members, said first and second blade means mounted on said frame each disposed at an angle of less than 90° on opposite sides of said support frame.

* * * * *